US005199529A

United States Patent [19]

Salmon

[11] Patent Number: 5,199,529

[45] Date of Patent: Apr. 6, 1993

[54] SELF ALIGNING SUPPORTS FOR ELEVATOR CAB

[75] Inventor: John K. Salmon, South Windsor, Conn.

[73] Assignee: Otis Elevator Company, Farmington, Conn.

[21] Appl. No.: 795,567

[22] Filed: Nov. 21, 1991

[51] Int. Cl.[5] ..... B66B 9/00

[52] U.S. Cl. ..... 187/1 R; 248/581

[58] Field of Search ..... 187/1 R, 95; 248/581, 248/603, 580, 610

[56] References Cited

U.S. PATENT DOCUMENTS

| | | | |
|---|---|---|---|
| 4,113,064 | 9/1978 | Shigeta et al. | 187/1 R |
| 4,225,014 | 9/1980 | Wheeler | 187/1 R |
| 4,899,852 | 2/1990 | Salmon et al. | 187/1 R |
| 5,005,671 | 4/1991 | Aime et al. | 187/1 R |

FOREIGN PATENT DOCUMENTS 2-127384 5/1990 Japan .

*Primary Examiner*—Robert P. Olszewski
*Assistant Examiner*—Kenneth Noland
*Attorney, Agent, or Firm*—William W. Jones

[57] ABSTRACT

An elevator cab is supported in a frame by a plurality of substantially oval supports which have circular, in section, ends engaging planar surfaces on cab and frame. The sides of the supports are cylindrical and include an annular tooth surrounding each of the circular ends. An annular valley is interposed between the end and tooth on both ends of the support. The planar surfaces on the cab frame are formed by cup-shaped members having flat basins surrounded by an annular tooth. The rounded end of each support rolls in the basin of cup-shaped member, and the annular tooth on the cup-shaped member limits the extent of shifting of the supports by selectively entering the annular valley on the end of the support. Controlled pendulum type movement of the cab in the frame is thus achieved.

6 Claims, 2 Drawing Sheets

SELF ALIGNING SUPPORTS FOR ELEVATOR CAB

TECHNICAL FIELD

This invention relates to a system for use in supporting an elevator cab in a cab assembly frame. More particularly, this invention relates to an improved system of the character described which allows controlled lateral movement of the cab in the frame.

BACKGROUND ART

Modern elevators include a passenger car assembly having a cab mounted in a frame. The frame carries the guide rail guides and thus will be directly subjected to shocks resulting from rail anomalies such as rail roughness, rail joints, rail deformities, and the like. It is desirable to shield the cab and its passengers from shock-induced vibrations so as to provide as pleasant an elevator ride as possible. One approach to providing a low vibration cab ride is to mount the cab in the frame in such a manner as to allow the cab to move laterally within the frame when the frame is jolted. U.S. Pat. No. 4,899,852 granted Feb. 13, 1990 to J. K. Salmon et al. discloses such a system wherein the cab is suspended in the frame by suspension rods, and moves within the frame on the rods like a pendulum. Movement of the bottom of the cab is controlled by dashpots connecting the cab bottom to the frame. This system is good for inclusion in new equipment but is not well suited for modernizing existing equipment. U.S. Pat. No. 5,005,671 granted Apr. 9, 1991 to M. Aime et al. discloses an apparatus for damping elevator car oscillations, when the car rides on deformed elastomeric spheres mounted on the frame. The spring centering device interconnects the center of the car bottom with the center of the frame bottom and is operable to restore the car to its original position when it oscillates in the frame. U.S. Pat. No. 4,113,064 granted Sep. 12, 1978 to M. Shigeta et al. discloses an elevator car mounting wherein the car sits in the frame and is free for limited lateral movement in the frame. The bottom of the car rides on sets of steel spheres freely movable between the car bottom and the frame, and annular rubber bumpers tend to return the car to its original position when it oscillates. Such a system would be usable in modernization of older equipment. Japanese patent publication No. 2-127384(A), published May 16, 1990 to Hitachi Ltd. discloses an elevator system wherein a cab is movably mounted in a frame, and free to oscillate laterally in the frame. A movement damper in the form of a high viscosity fluid in a container on the frame floor is disclosed. A vibration member secured to the cab floor is immersed in the viscous fluid whereby latter will damp movements of the vibration member, and therefore, of the cab. A device for restoring the cab position on the frame does not appear to be disclosed.

DISCLOSURE OF THE INVENTION

This invention relates to a roller mount assembly for use in mounting an elevator cab in the elevator frame. The roller mount assembly permits lateral movement of the cab in the frame in response to vibrations or shocks imparted to the frame. The rolling movement is substantially friction-free and will occur in any direction throughout a horizontal 360° arc. The mount assembly includes a pair of opposed cup-shaped bases, one of which is mounted on the bottom of the cab and the other of which is mounted on a lower part of the frame. Each base has a recessed centered portion with a flat bottom which forms a primary planar support surface for the rolling component of the assembly. The flat base recesses are surrounded by an annular rim which forms a secondary support surface for the rolling component. The rolling component is sandwiched between the two bases and holds the two bases in a spaced-apart relationship. The outside surface of the rolling component is generally cylindrical, and the ends of the rolling component which contact the bases are spheroidal. More particularly, the central portions of each end of the rolling component are spheroidal, and are surrounded by an annular valley into which the annular rims on the respective bases enter. The annular valley is in turn surrounded by an annular tooth having a convex inner rolling surface which contacts the secondary support surface on the base. The spheroidal end surfaces are not struck from the same center point, but rather emanate from two separate center points which are spaced apart from each other along the axis of the cylindrical side wall. The sum of these radii is greater than the overall height of the element. This ensures that when the cab rolls to one side or the other in the frame, it will lift very slightly thereby creating a condition which allows a gravitational force to return the cab to its original position when the side roll stops. Thus the cab will roll to one side and thus return on its own without the need of any auxiliary return spring components, such as are disclosed on the aforesaid prior art.

It is therefore an object of this invention to provide an improved rolling mount assembly for mounting an elevator cab in an elevator cab assembly frame.

It is an additional object of this invention to provide an elevator cab mount assembly of the character described which provides substantially friction-free movement of the cab within the frame.

It is another object of this invention to provide an elevator cab mount assembly of the character described which provides an inherent return force which tends to return the cab after any initial lateral movement thereof.

It is a further object of this invention to provide an elevator cab mount assembly of the character described which has a minimal number of component parts and which does not require that the cab be suspended in the frame.

It is a further object of this invention to provide an elevator mount assembly of the character described which maintains orientation between components smoothly and indefinitely.

These and other objects and advantages of the invention will become more readily apparent from the following detailed description of a preferred embodiment thereof, when taken in conjunction with the accompanying drawings, in which:

BEST MODE FOR CARRYING OUT THE INVENTION

Figure 1:
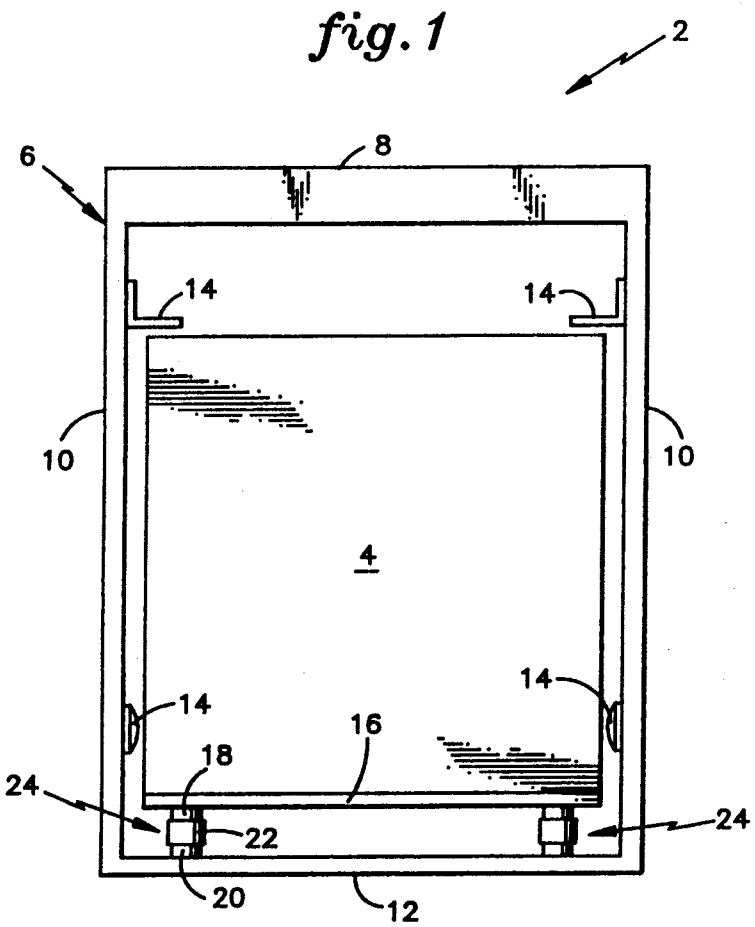
FIG. 1 is a somewhat schematic elevational view of an elevator cab assembly showing the cab mounted in the frame with a preferred embodiment of the mount assembly of this invention.

Referring to the drawings, there is shown in FIG. 1 a somewhat schematic representation of an elevator cab assembly denoted generally by the numeral 2. The assembly 2 includes: a passenger cab 4 which is mounted in a frame 6 having a horizontal upper crosshead 8 to which hoist cables (not shown) are attached; side stiles 10; and a lower buffer platform 12. It will be understood that sets of rail guides (not shown) such as rollers or the like are mounted on the corners of the frame 6 and engage guide rails (not shown) in the elevator hoistway to guide movement of the cab assembly 2 in the hoistway. Absolute cab movement limiters 14 are mounted on the stiles 10. The floor 16 of the cab 4 has cups 18 affixed thereto opposite matching cups 20 which are affixed to the frame platform. Rolling members 22 are sandwiched between the cups 18 and 20 to complete each support assembly. In all, there are at least four of these support assemblies 24, one at each corner of the cab 4. Additional support points may be added to distribute the platform load. As described hereinafter, the support assemblies 24 allow smooth and controlled lateral movement of the cab 4 in the frame 6.

Figure 2:
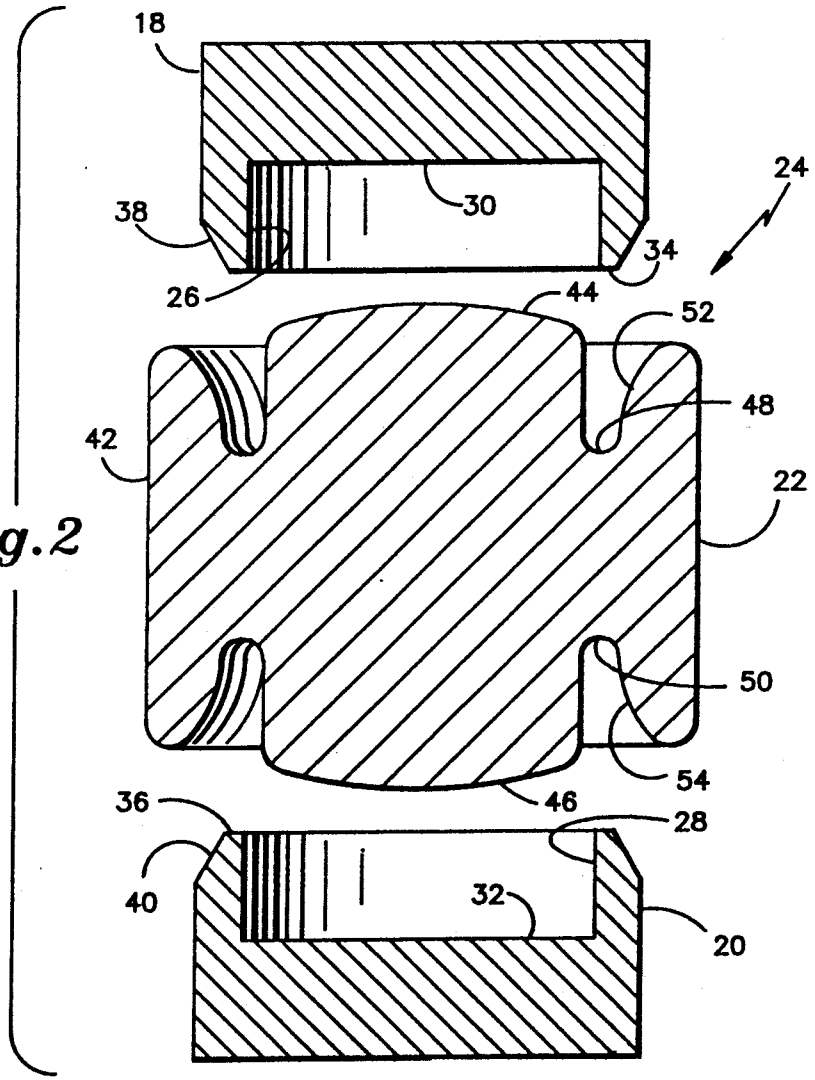
FIG. 2 is an exploded sectional view of the components of the mount assembly of FIG. 1.

FIG. 2 shows details of one of the support assemblies 24. The cups 18 and 20 are formed with opposed recesses 26 and 28 each having flat bottom surfaces 30 and 32 which form the primary contact surfaces for the rolling number 22. Annular bosses 34 and 36 surround the primary contact surfaces 30 and 32 respectively, and annular frustoconical secondary contact surfaces 38 and 40 are formed on the outer sides of the bosses 34 and 36 respectively. The rolling member 22 has a generally cylindrical outer side surface 42, and spherical end surfaces 44 and 46 of radii $R_2$ and $R_1$, respectively, which form the primary rolling surfaces of the member 22. The primary rolling surfaces 44 and 46 are surrounded by annular valleys 48 and 50 respectively, which in turn are surrounded by annular convex curvilinear secondary rolling surfaces 52 and 54 respectively.

Figure 3:
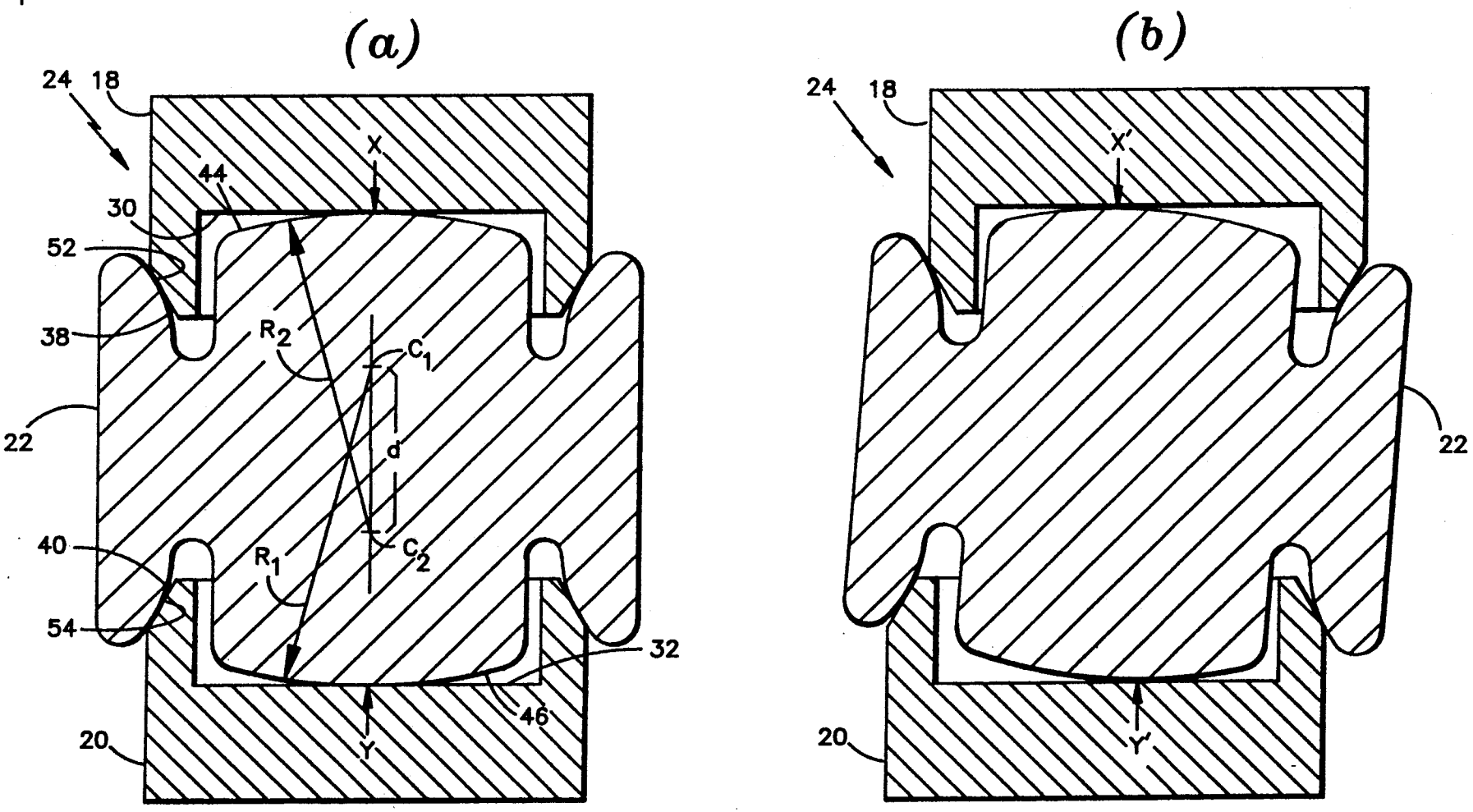
FIG. 3 is a sectional view of the assembly showing in part (a) the relative positions of the three component parts when the cab and frame are in motion equilibrium with each other and in part (b), the relative positions of the three component parts when the cab has moved relative to the frame.

Referring to FIG. 3, further details of the mounting assembly 24 are shown. The mounting assembly 24 is shown in FIG. 3(*a*) as it aligns when the cab is properly centered in the frame. It will be observed that the spheroidal surface 46 has its center point at point $C_1$, while the spheroidal surface 44 has its center point at point $C_2$, and that points $C_1$ and $C_2$ are spaced apart a distance d. When the cab is in its neutral position in the frame, the cups 18 and 20 will be coaxially aligned, and point contact will be established between the surfaces 30, 44 and 32, 46 at points X and Y, respectively. The relationship between the annular surfaces 52, 38, and 54, 40 is that of a rack and gear, the surfaces 38 and 40 representing the rack, and the surfaces 52 and 54 representing the gear teeth. The spheroidal surfaces 44 and 46 and the flat surfaces 30 and 32 are the pitch surfaces of the gears and racks respectively. These surfaces roll without slipping under ideal conditions. The surfaces 38, 52, and 40, 54 correspond to tooth surfaces of gear elements which prevent creeping of the components out of relative position, smoothly and with little friction. The surfaces can be of involute profile or of any suitable profile for gear and rack surfaces. The involute profile with its constant pressure angle is preferred. It will be noted that by offsetting the respective center points $C_1$ and $C_2$, the vertical distance between points X and Y, on surfaces 44 and 46 in 3(*a*) will be less then the distance between points X' and Y' on surfaces 44 and 46 in 3(*b*).

Note that X' is at the horizontal tangent point on 44. Y' is at the horizontal tangent point of 46.

They are respectively vertically above $C_2$ and below $C_1$, the centers of curvature of the two faces.

When element 22 tilts at an angle $\Theta$, the vertical distance between X' and Y' is equal to $R_1+R_2-d \cos \Theta$. Hence, when $\Theta$ is zero, the elevation of Y' is a minimum as the tilt increases, the elevation increases.

The action can be approximated for small displacements of 18 with respect to 20 as equivalent to a pendulum with the following effective length, leq:

$$leq = \frac{(R_1 + R_2 - d)^2}{d}$$

FIG. 3(*b*) shows the orientation of the assembly components 18, 20 and 22 when the cab has shifted to the right (as seen in FIG. 3(*b*)) relative to the frame. When shifting of the cab relative to the frame occurs, lateral movement of the cup 18 relative to the cup 20 causes the rolling member 22 to pivot, as shown in FIG. 3(*b*). In addition to laterally shifting, the cup 18 also rises vertically slightly due to the locations of $C_1$ and $C_2$. The curved surfaces 52 and 54 remain in contact with or have a minuscule and roll clearance from the frustoconical surfaces 38 and 40 respectively in the manner of a gear tooth and rack as previously noted. The fact that the cup 18 rises vertically during lateral movement of the cab creates a gravitational force that tends to have the cab return to its equilibrium position since the assemblies 24 will return to their FIG. 3(*a*) positions when the disturbing force is removed from the cab. Alternatively, the restoring action can be considered to result from a shift of contact points. In 3(*b*) Y' is to the right of X'. Hence a restoring torque exists.

It will be readily apparent that the mount assemblies will provide a pendulum-like connection between the cab and the frame that increases the ride quality in the cab. The assemblies can be retrofitted onto existing equipment in the field to upgrade ride quality of older equipment. If so desired, movement dampers can be used in conjunction with this invention to absorb high frequency forces imparted to the cab assembly during operation of the elevator.

Since many changes and variations of the disclosed embodiment of the invention may be made without departing from the inventive concept, it is not intended to limit the invention otherwise than as required by the appended claims.

What is claimed is:

1. A self aligning elevator cab mounting assembly for supporting an elevator cab in an elevator cab frame in a pendulum fashion, said assembly comprising:

a) opposed seat means for securement to the cab and the frame; and b) a non-compressible rolling member for sandwiching between said seat means, said rolling member having opposed upper and lower, spheroidal end surfaces which engage said seat means to provide point contact with each of said seat means, and a substantially cylindrical side surface disposed radially outwardly of said spheroidal end surfaces.

2. The mounting assembly of claim 1 further comprising an annular curvilinear surface surrounding each of said spheroidal end surfaces on said rolling member, said annular curvilinear surfaces extending from said cylindrical side surface and facing each of said spheroidal end surfaces.

3. The mounting assembly of claim 2 wherein the center points of said upper and lower spheroidal end surfaces are disposed in the lower and upper halves of said rolling member respectively.

4. The mounting assembly of claim 3 wherein said seat means are each substantially cup-shaped and include a horizontal centrally located flat surface for engagement by said spheroidal end surfaces of said rolling member, and also include an annular outer frustoconical rack surface surrounding said flat surfaces, said rack surface on each seat means being operable to engage a respective one of said annular curvilinear surfaces on said rolling member.

5. An elevator assembly comprising an elevator cab and an elevator cab frame, said cab being positioned within said frame and mounted on a plurality of self aligning mount assemblies positioned between a floor of said cab and a lower cross piece of said cab frame, said mount assemblies each including:

a) a first cup-shaped member secured to said cab floor;

b) a second cup-shaped member secured to said frame cross piece;

c) said first and second cup-shaped members including flat horizontal seating surfaces disposed opposite to and facing each other; and d) a generally cylindrical, noncompressible rolling member interposed between said cup-shaped members, said rolling member having spheroidal end surfaces engaging said seating surfaces on said cup-shaped members, said rolling member being operable to pivot between said cup-shaped members when the elevator cab is subjected to horizontally vectored forces, and said spheroidal end surfaces and seating surfaces providing means for lifting said cab with respect to said cab frame when said cab is subjected to horizontally vectored forces whereby said cab will tend to gravitate to an initial neutral position upon dissipation of said horizontally vectored forces.

6. The elevator assembly of claim 5 wherein said cup-shaped members include annular frustoconical surfaces surrounding said seating surfaces, and said rolling member includes annular curvilinear surfaces surrounding said spheroidal end surfaces, said annular frustoconical and curvilinear surfaces combining to provide rack and tooth means for controlling and limiting movement of said spheroidal end surfaces over said seating surfaces when said cab is subjected to horizontally vectored forces.

* * * * *